United States Patent [19]

Eriksen

[11] Patent Number: 4,753,015

[45] Date of Patent: Jun. 28, 1988

[54] METHOD FOR HEAT TREATING A WEB SHAPED MATERIAL, AND A DEVICE IN A PLANT FOR HEAT TREATMENT OF A RUNNING WEB

[75] Inventor: Gunnar Eriksen, Asker, Norway

[73] Assignee: Thune-Eureka A/S, Tranby, Norway

[21] Appl. No.: 7,562

[22] Filed: Jan. 28, 1987

[51] Int. Cl.[4] ..... F26B 3/06; F26B 13/10

[52] U.S. Cl. ..... 34/23; 34/155; 34/160

[58] Field of Search ..... 34/54, 155, 158, 160, 34/162

[56] References Cited

U.S. PATENT DOCUMENTS

| | | | |
|---|---|---|---|
| 2,621,422 | 12/1952 | Deck | 34/158 |
| 2,792,587 | 5/1957 | Rose et al. | 34/160 |
| 2,894,334 | 7/1959 | Thygeson | 34/158 |
| 2,916,796 | 12/1959 | Sibel | 34/158 |
| 4,137,649 | 2/1979 | Fleissner | 34/155 |
| 4,301,602 | 11/1981 | Grondin et al. | 34/160 |
| 4,505,050 | 3/1985 | Jung et al. | 34/54 |

*Primary Examiner*—Larry I. Schwartz

*Attorney, Agent, or Firm*—Young & Thompson

[57] ABSTRACT

A method and a device for simulating a larger width of felt/wire than the real one in a hot air plant for heat treatment of the felt/wire avoids a temperature drop towards the edges and of achieving a homogeneous temperature treatment all over the width of the felt-/wire. Along the edges of the felt/wire adjustable sheetlike members or roller blinds are provided in the heating zone.

5 Claims, 2 Drawing Sheets

METHOD FOR HEAT TREATING A WEB SHAPED MATERIAL, AND A DEVICE IN A PLANT FOR HEAT TREATMENT OF A RUNNING WEB

The invention relates to a method for heat treating web shaped material, wherein said web shaped material is moved through a heating zone where a hot treating medium, e.g. hot air, is made to flow across said web and towards the web plane across a width greater than that of the web.

The invention also relates to a device in a plant for heat treating a running web, which plant comprises a device for emitting a flow of a heat treating medium, e.g. hot air, across said web and towards the web plane, and a device for receiving said medium flow on the other side of said web.

The present invention especially relates to heat treatment of felt and wire that are used in paper machines. Felt and wire used in paper machines must be pretreated in a tensioned state in a stretch/drying/fixing machine so that desired properties are achieved. One of the most important processes is heat treatment (thermo fixing and drying) that may, advantageously, take place in a hot air plant. A hot air plant for a stretch/ drying-/fixing machine will commonly comprise two air distributing sections in the shape of box shaped elements extending along the full machine width and placed on opposite sides of said felt/wire (above/below), in a section where said felt/ wire shows a straight run. Said felt/wire, below called web, is kept moving with a controlled tension by the aid of two or more rollers and a drive means, and is passed through a controlled heating zone between said two box shaped members. It is a task of said box shaped members or air sections to ensure that air having constant temperature all over the heating zone is blown/sucked in a homogeneously distributed manner. The width of the heating zone is given. The webs to be treated, however, will have various widths,dependent on the width of the paper machine for which they are intended. Often, there will, thus, arise a situation of a web to be treated in a stretch/-drying/fixing machine not filling the entire width of said heating zone.

For many years there have been edge problems during heat treatment of felt/wire in a hot air plant as indicated above. In the heating zone, some distance inwards from the edge, there will be stable pressure conditions around said felt/wire. But the pressure will decrease towards the edges and this will result in a lateral air flow outside the felt/wire. This will in turn result in a temperature drop towards the edges which may be very disadvantageous to the quality of the treated webs.

It is an object of the present invention to eliminate said disadvantages.

According to the invention it is, thus, especially with reference to a stretch/drying/fixing machine for felt-/wire, proposed to provide the box members with adjustable false edges in order to simulate a larger felt-/wire width than the real width in the actual case.

Such simulation may be achieved by introducing a stationary member in the heating zone closely adjacent to the web edge or web edges. Pressure conditions in said heating zone will be adjusted in accordance with the simulated web width, and the temperature drop is transferred to said stationary member. The result is a perfect temperature treatment of the web from one edge to the other.

The invention will now be disclosed in more detail with reference to the drawings wherein FIG. 1 is a diagrammatic side view of a stretch/-drying/fixing machine that is provided with a hot air plant;

Figure 1:
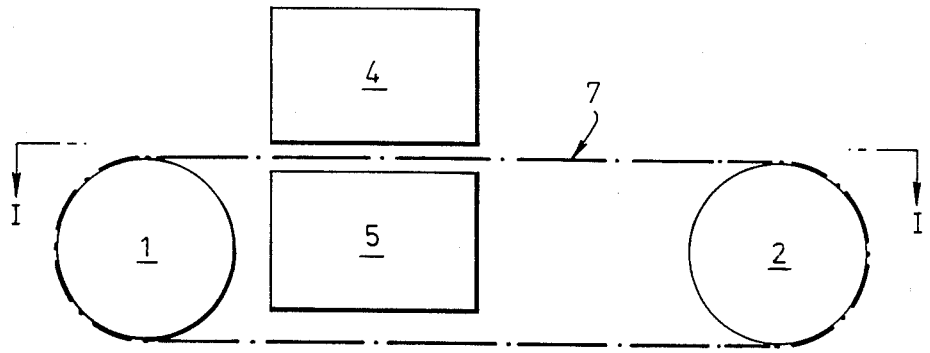
Figure 2:
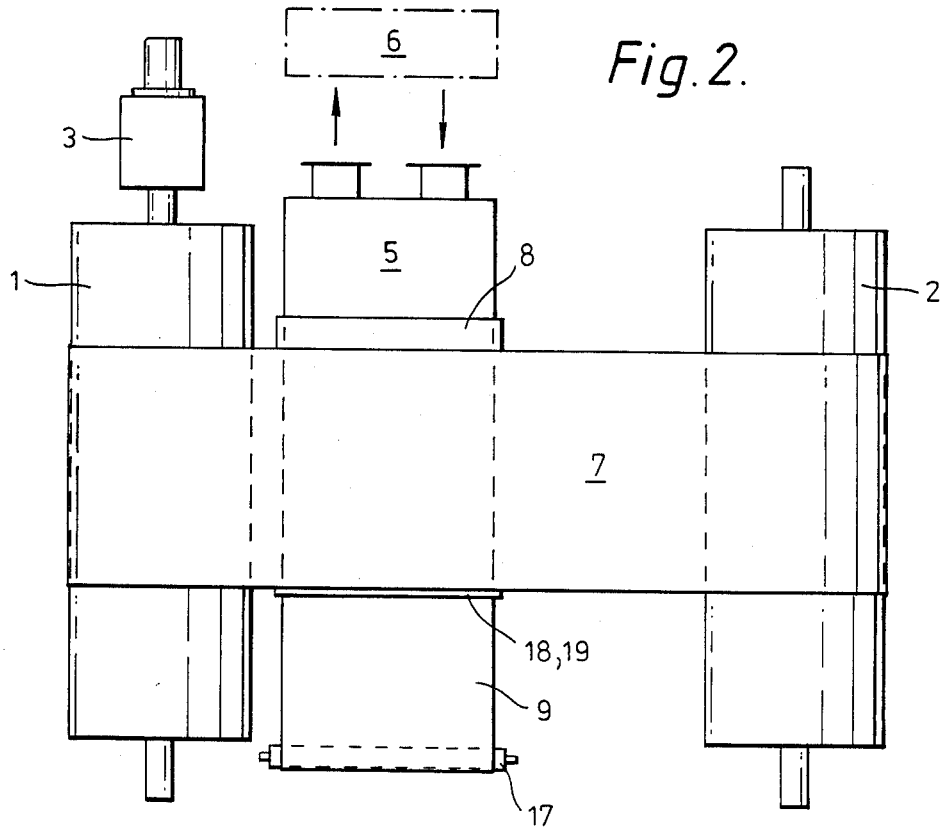
FIG. 2 is a diagrammatic plan view of the machine shown in FIG. 1.

In FIGS. 1 and 2 the essential parts of a stretch/-drying/fixing machine are shown. Thus, said machine comprises two stretch rollers 1 and 2. One stretch roller 1 is provided with a motor drive 3. Furthermore, said machine comprises two box shaped members 4 and 4 which are part of a hot air plant. Said box shaped members 4 and 5 are connected with a hot air unit 6 outside said machine for supply and return of hot air in a closed circulation.

The web, in this case a felt or wire 7,to be treated is placed like an endless belt around rollers 1 and 2. The rollers are rotated by the aid of motor 3, and web 7 will then move in the opening between upper and lower box shaped member 4,5 which is the heating zone.

As shown in FIG. 2, a web is treated which is narrower than rollers 1, 2, and box shaped members 4, 5. In order to solve the edge problems and achieve a more homogeneous distribution of air two possible false edges are indicated in FIG. 2, viz. a false edge 8 and a false edge 9. The hot air flow between box shaped members 4,5 will impinge on these false edges, and a simulated larger width of web than the real one will be formed. Pressure conditions in the heating zone between said box shaped members will adjust to said simulated width of the web, and equalization of temperature is achieved all over the width of the web.

Said false edges may be realized in several manners. FIG. 4 shows two possible embodiments of said false edges 8 and 9 in FIG. 2, see also FIG. 3.

In FIG. 4 said two stretch rollers 1 and 2, web 7 to be treated, and lower box shaped member 5 forming part of said heating zone are shown. Box shaped member 5 as well as box shaped member 4 is provided with slots or openings, not shown, enabling a hot air flow to be passed between box shaped members 4,5 through web 7.

Along each transverse lateral side 10 and 11 of box member 5 a rail 12, 13 is provided.

Figure 3:
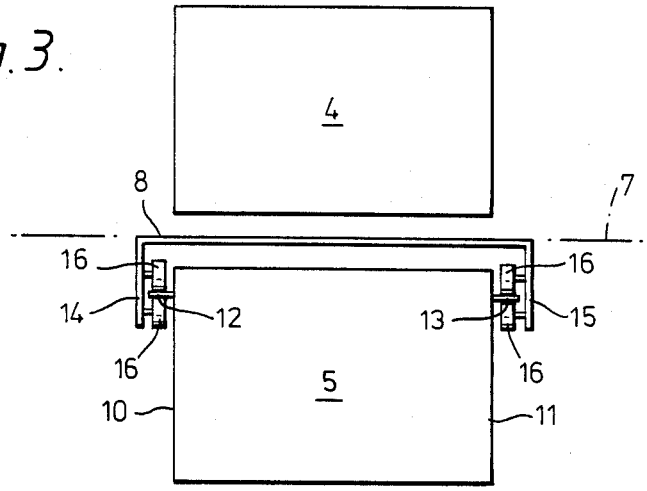
FIG. 3 is a sectional view through the box elements shown in FIGS. 1 and 2.
Figure 4:
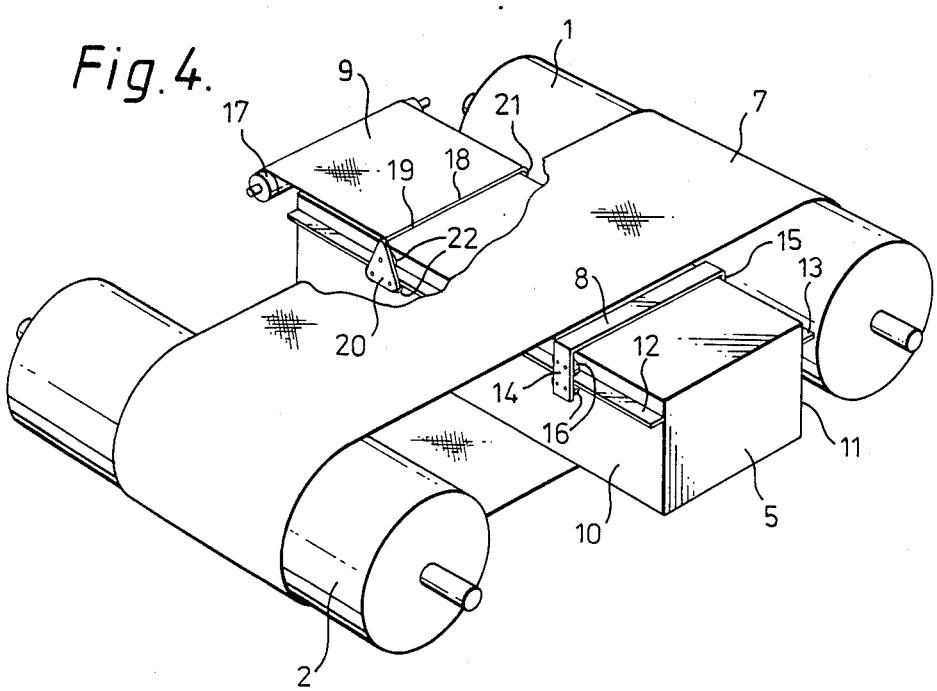
FIG. 4 is a diagrammatic view in perspective of the plant, with the upper box shaped member removed.

One of the false edges 8 is, in this case, made from a plate that has bent end portions 14, 15, and here four rollers 16 are mounted to run on the upper side and the lower side, resp. of each guide rail 12,13, see FIGS. 3 and 4. Member 8 can, thus, be displaced forward and backward transversely of the path of web 7 in a simple manner to be adjusted adjacent to the web edge, as shown in FIGS. 2 and 4.

On the other side of said machine another possible embodiment of a false edge 9 is shown, in this case in the shape of a roller blind 17 the free sheet edge 18 of which is attached to a bar or the like 19. Said bar 19 is carried by two small carriages 20, 21 which are each provided with rollers 22 running on the upper side and lower side, resp. of guide rail 12, 13. In this manner the roller blind sheet can be pulled with its rim to the adjacent web edge, as shown in FIGS. 2 and 4.

Member 8 may obviously, be connected with a drive motor (not shown) which acts on rollers 16 , if desired, to be remotely controlled into the correct position.

Manual adjustment is, naturally, possible as well. Other moving systems may be used, e.g. a string drive, etc. Said roller blind embodiment 9 may be supplied with a motor drive for said small carriages 20,21, i.e. their rollers 22. In this case other adjustment devices may be used, if desired, devices that those skilled in the art will select. Obviously, it is possible to adjust said carriages by hand.

It may be advantageous to use false edges 8,9 showing the same permeability as the used web material 7. This may easily be achieved by forming said roller blind sheet from a material corresponding to that of web 7. Member 8 may also be designed so as to have portions of the member extending along said web rim or the entire member 8 consist of a sheet corresponding to the material of web 7. This may, e.g. be realized by connecting portions 14 and 15 of member 8 by two parallel braces, and by stretching a sheet or the like between said braces.

In FIGS. 2 and 4 two different embodiments of false edges are shown. These embodiments, obviously, may be used together or separately, or in combination with other practical embodiments of the false edges.

Having described my inventon, I claim:

1. In a method for heat treating gas-permeable web shaped material by moving the web shaped material through a heating zone in which a hot treating fluid is passed in a flow toward and through the web; the improvement comprising positioning along both edges of the web in said heating zone a simulated web enlargement having a permeability corresponding to that of the web, each said web enlargement having an edge substantially parallel to and closely adjacent a corresponding said web edge in said heating zone and extending a substantial distance in a direction away from the web, and passing the hot treating fluid not only through the full width of the web but also through each said web enlargement on each side of the web.

2. Apparatus for heat treating gas-permeable web shaped material by moving the web shaped material through a heating zone in which a hot treating fluid is passed in a flow toward and through the web; the improvement comprising, along both edges of the web in said heating zone, a simulated web enlargement having a permeability corresponding to that of the web, each said web enlargement having an edge substantially parallel to and closely adjacent a corresponding said web edge in said heating zone and extending a substantial distance in a direction away from the web, and means for passing the hot treating fluid not only through the full width of the web but also through each said web enlargement on each side of the web.

3. Apparatus as claimed in claim 2, in which each said enlargement is a plate.

4. Apparatus as claimed in claim 3, and rollers mounting each said plate on guide rails extending in a direction transverse to the length of the web.

5. Apparatus as claimed in cliam 2, in which said enlargement is sheet material wound up on a roller, and carriage means for adjustably supporting an end of said sheet material remote from said roller.

* * * * *